United States Patent [19]

Rones et al.

[11] Patent Number: 4,478,647

[45] Date of Patent: Oct. 23, 1984

[54] PROCESS FOR THE TREATMENT OF SPENT PICKLING PASTE

[75] Inventors: Josef Rones; Siegfried Moller, both of Frankfurt am Main; Kurt Moesner, Offenbach am Main, all of Fed. Rep. of Germany

[73] Assignee: Parker Chemical Company, Madison Heights, Mich.

[21] Appl. No.: 524,503

[22] Filed: Aug. 18, 1983

[30] Foreign Application Priority Data

Aug. 18, 1982 [DE] Fed. Rep. of Germany ..... 3230603

[51] Int. Cl.[3] ..... C23G 1/36

[52] U.S. Cl. ..... 134/13; 134/27; 134/29

[58] Field of Search ..... 134/2, 3, 4, 13, 27, 134/28, 29, 41; 423/DIG. 1

[56] References Cited

U.S. PATENT DOCUMENTS

| | | | |
|---|---|---|---|
| 3,800,024 | 3/1974 | Forsell et al. | 423/DIG. 1 X |
| 3,959,132 | 5/1976 | Singh | 134/13 X |
| 4,045,339 | 8/1977 | Korenowski et al. | 134/13 X |
| 4,400,289 | 8/1983 | Geldner et al. | 134/3 X |

FOREIGN PATENT DOCUMENTS

| | | | |
|---|---|---|---|
| 843100 | 8/1960 | United Kingdom | 134/27 |

*Primary Examiner*—Marc L. Caroff

*Attorney, Agent, or Firm*—Arthur E. Kluegel

[57] ABSTRACT

A process for treating spent fluoride-containing pickling paste on metal surfaces by applying to the spent pickling paste on the metal surface an aqueous treating paste composition comprising calcium carbonate having a particle size not in excess of about 5 microns and an alkali metal bicarbonate, which composition has a pH which is not in excess of about 9.5.

11 Claims, No Drawings

PROCESS FOR THE TREATMENT OF SPENT PICKLING PASTE

This invention relates to a process for the treatment of spent pickling pastes and, more particularly, relates to a process for treating spent fluoride-containing pickling pastes on metal surfaces to convert them to products which may be disposed of without pollution of the environment.

BACKGROUND OF THE INVENTION

Metal surfaces, such as those of steel and/or aluminum and their alloys, frequently contain unattractive and corrosion-promoting oxide layers which may be formed as a result of environmental exposure and/or heat treating operations, such as welding. Typically, such oxide layers are removed by treating the metal surfaces with an acid solution, such as those based on hydrochloric, sulfuric, phosphoric or hydrofluoric acid, or by treatment with an acid-containing paste. The latter compositions are normally applied only to the areas which are to be cleaned, and are frequently used on large articles or where there is only localized oxide formation. As a result of the treatment with the acid-containing solutions or paste, a part of the oxides and the metal substrates adhering to the oxides are dissolved so that the oxides lose their adhesion to the metal surface. After an appropriate contact time, the solutions or paste are rinsed off with water or removed with brushes.

Exemplary of such acid cleaning and etching solutions is that disclosed in German Patent No. 1950560, which contains hydrofluoric acid, a magnesium compound, at least one acid selected from nitric acid, phosphoric acid and sulfuric acid, either in the form of free acid or the acid salts, and a particular sulfonic acid. Exemplary of pickling or derusting pastes which have been used are those disclosed in German Patent No. 1082475, which contain phosphoric acid and a thickener, such as a hydrolyzable oil or fatty acid which can be converted to a soap. A further pickling and derusting paste which has been proposed is described in U.S. patent application Ser. No. 346331, now U.S. Pat. No. 4,400,289 filed Feb. 5, 1982 (German Published patent application No. 3105508). This composition contains fluoride ions, a mixture of compounds of calcium and trivalent iron and/or aluminum and has an acidity corresponding to at least 10% by weight of free acid, calculated as 100% HF. This pickling paste composition is particularly suitable for the treatment of steel alloys.

The use of pickling pastes, particularly those which contain fluoride, frequently present problems which are not encountered when pickling solutions are used. For example, where the pickling pastes are used on relatively large articles, suitable rinsing tanks may not be available. Additionally, the waste waters formed when the spent pickling pastes are rinsed from metal surfaces, which waste waters are strongly acidic and contain fluoride, may not be discharged to municipal sewer systems or otherwise discarded, without being treated to reduce the acidity and remove the contained fluoride ions. Typically, it is customary to collect such waste waters and treat them with calcium hydroxide to raise the pH to within the range of about 6.5 to 9.5. The calcium hydroxide further reacts with the fluoride ions in the waste waters to form insoluble calcium fluoride which are separated from the solution and the remaining liquid, at a neutral or slightly alkaline pH, can then be discharged to municipal sewage systems.

This procedure, however, presents some difficulties in that the solutions or suspensions of calcium hydroxide, or milk of lime, do not completely react immediately with the acidic, fluoride-containing waste waters. Thus, although the amount of calcium hydroxide added initially results in a solution pH within the desired range, as subsequent reaction occurs, the solution pH rises above the permissible level. Accordingly, in treating these waste waters in this manner, precise checking of the solution alkalinity and frequent readjustments of the pH are required, which involves repeated and time consuming monitoring steps.

To overcome this difficulty, it has been proposed that the fluoride-containing acidic waste waters can be treated by flowing them over granulated calcium carbonate, e.g., marble. This procedure, however, has been found to have little commercial application since the calcium carbonate rapidly becomes coated with insoluble calcium fluoride, thus preventing any further reaction from taking place.

It is, therefore, an object of the present invention to provide an improved process for the treatment of spent pickling paste on metal surfaces.

A further object of the present invention is to provide an improved process for the treatment of spent pickling pastes to convert them to a form in which they may be safely disposed of, which process overcomes the disadvantages of the prior art processes and is simple and economical to carry out.

These and other objects will become apparent to those of ordinary skill in the art from the description of the invention which follows.

SUMMARY OF THE INVENTION

In accordance with the present invention, a metal surface containing a spent pickling paste is treated by the application, to the spent pickling paste, of an aqueous paste composition having a pH which is not in excess of about 9.5, which aqueous paste composition contains an alkali metal bicarbonate and calcium carbonate which has a particle size which is not in excess of about 5 microns. This paste is applied to the spent pickling paste on the metal surface and is retained in contact with the spent pickling paste for a sufficient time to permit the calcium ions in the treating paste to react with the fluoride ions of the spent pickling paste and convert them to an insoluble calcium fluoride. Thereafter, the treating paste and reaction product residues can be removed from the metal surface by water rinsing and the resulting waste water can be discharged to municipal sewage systems, once the water insoluble portion has been removed, without further treatment.

DETAILED DESCRIPTION OF THE INVENTION

The treating composition used in the practice of the method of the present invention is an aqueous paste comprising calcium carbonate which has a particle size which is not in excess of about 5 microns and an alkali metal bicarbonate, which aqueous paste has a pH which is not in excess of about 9.5. Typically, the aqueous treating paste will contain the calcium carbonate in an amount of from about 20 to about 50% by weight and the alkali metal bicarbonate in an amount of from about 20 to about 50% by weight (calculated as $NaHCO_3$). In a particularly preferred embodiment, the aqueous treating paste will contain the calcium carbonate in an amount from about 30 to 40% by weight and the alkali metal bicarbonate in an amount of from about 30 to about 40% by weight. It is to be appreciated that the foregoing amounts of the calcium carbonate and alkali metal bicarbonate are merely exemplary of the amounts which may be used and aqueous paste compositions containing amounts of these components which are outside of the ranges indicated may also be satisfactorily employed. It is only necessary that the treating paste used contain sufficient calcium ions to convert the desired amount of fluoride ions in the spent pickling paste to insoluble calcium fluoride. Additionally, it has been found that the simultaneous presence of the alkali metal bicarbonate in the composition has a neutralizing effect, so that the pH of the composition does not exceed about 8.4, even when excessive amounts of the composition are utilized in treating the spent pickling paste.

It has been found that the particle size of the calcium carbonate used in the treating paste composition is important and that where the particles are of a size in excess of about 5 microns, complete reaction with the fluoride ions in the spent pickling paste does not occur. In this instance, an external layer of calcium fluoride is formed on the treating paste and the calcium carbonate in the interior of the paste composition is prevented from undergoing further reaction with either the fluoride ions or the acidic components of the spent pickling paste. With calcium carbonate particle sizes which are not in excess of about 5 microns, a more complete reaction of the calcium carbonate occurs. As the calcium carbonate size is further reduced, there is an increase in the speed or velocity of the reaction and the flowability or brushability of the treating paste is improved. Preferably, the calcium carbonate component of the treating paste has a particle size which is not in excess of about 2 microns and, most preferably, has a particle size which is not in excess of about 1 micron. A particularly preferred form of calcium carbonate has been found to be one which has been produced by a precipitation process.

In addition to the calcium carbonate and alkali metal bicarbonate components, the aqueous treating past composition of the present invention may also contain a surfactant, typically in an amount from about 0.1 to about 10 grams per kilogram of the paste composition and preferably in an amount of from about 0.3 to about 3 grams per kilogram of the paste composition. Although various surfactant materials may be utilized, particularly suitable surfactants have been found to be the non-ionic and the anionic surfactants, most particularly, the oxyethylated alkyl phenols. The presence of such surfactants have been found to improve the flowability of the paste compositions and further accelerate the reaction of the calcium ions with the fluoride ions in the spent pickling paste on the metal surface.

The paste composition of the present invention has a pH which is not in excess of about 9.5. Typically, and depending upon the regulations in regard to waste water disposal, the pH of the paste is within the range of about 8 to 9. Where the desired paste composition pH is not achieved with the calcium carbonate and alkali metal bicarbonate components, small amounts of other alkaline compounds, such as sodium carbonate, may be included in the composition as is necessary to increase the pH to the desired level, up to the maximum pH of about 9.5.

In the practice of the method of the present invention, the aqueous treating paste is typically applied by means of brushing. Application by spray processes may also be used, however, particularly where the viscosity of the composition has been sufficiently reduced to make such application possible. The amount of the treating paste applied to the metal surface should be at least as great as the amount of the pickling paste which had been applied. The application of an excess amount of the treating paste, however, presents no problems since the reactions which take place and the reaction products formed do not cause any environmental pollution.

In this regard, it is to be noted that the conversion of the spent pickling paste to products which do not cause environmental pollution is accompanied by the evolution of carbon dioxide gas and the completion of this gas evolution, indicates that the reaction has been completed. Thus, the need for monitoring the amount of reaction, for example by measurement of the pH, is not necessary. Typically, the treating paste will be maintained in contact with the spent pickling paste for period of from about 1 to about 5 minutes. When the reaction of the treating paste with the spent pickling paste is complete, as evidenced by the cessation of the evolution of carbon dioxide gas, the reaction products on the metal surface are then removed by water rinsing. Depending upon the nature of the metal surface being treated, this water rinsing can be carried out by brushing or spraying and the resulting waste rinse liquid, after removal of insoluble materials by filtration or decanting, can be discharged into the municipal sewage systems.

The process of the present invention has been found to be particularly advantageous in that the components of the aqueous treating paste composition are relatively inexpensive and the composition has a long shelf life and can be handled without the need for special safety measures. Moreover, close controls are not required for the application of the treating paste since substantial excess amounts may be utilized without problems and the reaction products produced can be safely discarded without causing envirnonmental pollution.

In order that those skilled in the art may better understand the present invention and the manner in which it may be practiced, the following specific examples are given. In these examples, chromium/nickel steel pipe sections, having a weld seam, were treated with a pickling paste having the following composition:

| | |
|---|---|
| Nitric acid (50% by weight) | 30% by weight of the composition |
| Hydrofluoric acid (40% by weight) | 15% by weight of the composition |
| Barium sulfate | 55% by weight of the composition |

This pickling paste composition was applied to the weld seam in an amount of 100 grams per meter of weld seam and retained thereon for 15 minutes.

EXAMPLE 1

A treating past was prepared having the following composition:

| | |
|---|---|
| Calcium carbonate | 35% by weight |

-continued

| | |
|---|---|
| (particle size about 1 micron) | |
| Sodium bicarbonate | 35% by weight |
| Sodium carbonate | 2% by weight |
| Nonyl phenol oxyethylate (containing 10 ethyleneoxide groups) | 0.2% by weight |
| Water remainder. | |

This paste composition was applied to the pipe sections containing the spent pickling paste, as described above, in an amount of 100 grams per meter of weld seam. After remaining in contact with the pickling paste for a period of 5 minutes, the residue products on the metal surface were rinsed off with water and the resulting wash liquid was found to have a pH of 7.2 and a fluoride content of 20 milligrams per liter. After removal of the water-insoluble materials, by decanting, the remaining liquid could be discharged into the municipal sewage system without further treatment.

EXAMPLE 2

The procedure of Example 1 was repeated with the exception that the amount of the treating paste applied was 200 grams per meter of weld seam. Although a substantial excess of the treating paste was utilized, the resulting wash liquid was found to have a pH of only 7.8 and a fluoride content of 16 milligrams per liter and, after removal of the water insoluble material, as in example 1, could be discharged into the munticipal sewage system without further treatment.

EXAMPLE 3

By way of comparison, calcium carbonate milled to a particle size of 10–15 microns was mixed with water to form a paste having a solids content of 40% by weight and a pH of 8.5. The paste was applied as in Example 1, in an amount of 100 grams per meter of weld seam. After a residence time of 5 minutes, the reaction products were rinsed off with water and the wash liquid was found to have a pH of 4.0 and contained 180 milligrams per liter of fluoride ions. This wash liquid, even after removal of insoluble materials, could not be discharged to the municipal sewage systems without further treatment to adjust the pH.

EXAMPLE 4

The procedure of Example 3 was repeated with the exception that the amount of treating paste applied was 200 grams per meter of weld seam, thus substantially increasing the amount of calcium ions supplied for reaction with the spent pickling paste. The resulting wash liquid was found to have a pH of 5.0 and a fluoride content of 140 milligrams per liter and, as in the preceeding example, could not be discarded without further treatment.

EXAMPLE 5

By way of further comparison, a precipitated calcium carbonate having a particle size of about 1 micron was mixed with water to form a paste having a solids content of about 40% by weight and a pH of 8.5. This paste was applied onto the spent pickling paste, as in preceeding examples, in an amount of 100 grams per meter of weld seam. After a residence time of 5 minutes, the reaction products were rinsed off with water and a wash liquid was obtained which had a pH of 5.4 and a fluoride content of 70 milligrams per liter. This wash liquid could not be discharged to the municipal sewage system without further treatment to adjust the pH. These results show that although the use of a calcium carbonate having a smaller particle does result in an increase in the pH of the wash liquid and a decrease in its fluoride content, when the alkali metal bicarbonate is not present in the treating paste composition, the improvement obtained from the use of the smaller particle size calcium carbonate only is not sufficient to form a wash liquid which may be discharged without further treatment.

While it is apparent that the invention herein disclosed is well calculated to achieve the benefits and advantages as hereinabove set forth, it will be appreciated that the invention is susceptible to modification, variation and change without departing from the spirit thereof.

What is claimed is:

1. A process for treating spent fluoride-containing pickling paste on a metal surface which comprises applying to said spent pickling paste on said metal surface an aqueous treating paste composition which comprises calcium carbonate having a particle size not in excess of about 5 microns and an alkali metal bicarbonate, which composition has a pH which is not in excess of about 9.5, and maintaining said aqueous treating paste composition in contact with the spent pickling paste for a period sufficient to effect the reaction of the fluoride ions in the pickling paste with the calcium ions in the aqueous treating paste.

2. The process as claimed in claim 1 wherein the calcium carbonate of the aqueous treating paste has a particle size which is not in excess of about 2 microns.

3. The process as claimed in claim 2 wherein the calcium carbonate of the aqueous treating paste has a particle size which is not in excess of about 1 micron.

4. The process as claimed in claim 1 wherein the aqueous treating paste contains calcium carbonate in an amount of from about 20 to 50% by weight.

5. The process as claimed in claim 4 wherein the calcium carbonate content of the aqueous treating paste is from about 30 to 40% by weight.

6. The process as claimed in claim 1 wherein the aqueous treating paste composition contains the alkali metal bicarbonate in an amount from about 20 to 50% by weight, calculated as $NaHCO_3$.

7. The process as claimed in claim 6 wherein the alkali metal bicarbonate is present in an amount from about 30 to 40% by weight.

8. The process as claimed in claim 1 wherein the aqueous treating paste composition also contains a surfactant in an amount of from about 0.1 to 10 grams per kilogram of the paste composition.

9. The process as claimed in claim 8 wherein the surfactant is present in an amount of from about 0.3 to 3 grams per kilogram of the paste composition.

10. The process as claimed in claim 1 wherein the aqueous treating paste composition has a pH within the range of about 8–9.

11. The process as claimed in claim 1 wherein, following the completion of the reaction of the fluoride ions in the spent pickling paste with the calcium ions of the treating paste, the resulting products formed on the metal surface are removed by water rinsing.

* * * * *